US005855253A

United States Patent [19]

Bourgeois

[11] Patent Number: 5,855,253

[45] Date of Patent: Jan. 5, 1999

[54] MECHANICAL SECURITY DEVICE FOR ELEVATORS USED BETWEEN TWO LEVELS

[76] Inventor: Alain Bourgeois, 30 Pinewood Lawn, Dungarvan, Co. Waterford, Ireland

[21] Appl. No.: 633,213

[22] Filed: Apr. 16, 1996

[51] Int. Cl.[6] ..... B66B 13/12

[52] U.S. Cl. ..... 187/330; 187/313

[58] Field of Search ..... 187/335, 319, 187/330, 325, 324, 313; 49/116, 120

[56] References Cited

U.S. PATENT DOCUMENTS 5,584,365 12/1996 Tonna ..... 187/330

FOREIGN PATENT DOCUMENTS 1173339 2/1959 France .

*Primary Examiner*—Kenneth Noland

*Attorney, Agent, or Firm*—Young & Thompson

[57] ABSTRACT

This invention relates to a security device for an elevator which operates between two levels, comprised of a cabin (1) closed by a swinging door (2) which opens to the exterior, the cabin (1) moving by translational vertical motion from a lower level up to a booth (3), situated at the upper level and comprising a guard rail (4) closed by a swinging landing door (5) which is normally locked, opening toward the exterior of the cabin (1) by means of an articulation situated on the same side as the door (2) of the cabin (1), the elevator being characterized in that it is provided with means, although all of passive and entirely mechanical type, conditioning the translational vertical movement of the cabin (1) between the two levels, and the locking and unlocking of doors (2) and (5) at these levels.

16 Claims, 3 Drawing Sheets

MECHANICAL SECURITY DEVICE FOR ELEVATORS USED BETWEEN TWO LEVELS

FIELD OF THE INVENTION

This invention is aimed at an elevator used to transport people between a lower level and an upper level. This elevator is primarily intended to be installed in private residences to facilitate access to floors for people with impaired mobility, for example the elderly.

BACKGROUND OF THE INVENTION

For this type of installation, safety measures are usually provided by electric systems composed of, for example, electromagnetic locks which work with detectors, all of which are piloted by a control panel to which the various command circuits are connected. Generally, the complexity of these devices makes the cost of their purchase, installation, and maintenance prohibitive for private use. A way to make this kind of elevator accessible to private individuals consists in having all the functions performed by mechanical means, that are simple, reliable and only necessitate simplified maintenance. The motor function could, for example, be provided by a double extension jack and with constant speed like the one described in document FR 9311277 filed under this applicant's name. There remains nevertheless the safety issue, and in particular, being able to lock and unlock the doors with a simple mechanical device. The present invention is aimed at providing an elevator equipped with such a device.

SUMMARY OF THE INVENTION

To this end, it concerns an elevator which operates between a lower level and an upper level, comprised of a cabin closed by a swinging door which opens to the exterior, said cabin traveling vertically from a lower level up to a booth, situated at the upper level and comprised of a guard rail closed by a swinging landing door normally locked, that opens toward the exterior of the cabin by means of an articulation situated on the same side as door 2 of cabin 1, said elevator being characterized in that it is provided with means allowing to:

- automatically unlock the cabin door when said cabin arrives at the right place on the upper or lower level,
- block the cabin at the lower level until the door to said cabin has been closed and manually locked,
- lock the door of the cabin between the upper and lower levels,
- automatically join in rotation around their respective articulations the cabin door and the landing door when said cabin reaches the upper level,
- automatically disconnect the cabin door and the landing door when said cabin leaves the upper level,
- automatically unlock, upon upward movement of the cabin, the landing door when said cabin reaches the upper level,
- upon downward movement of the cabin leaving the upper level, automatically completely close the landing door and the door of said cabin, and simultaneously lock said doors, the swinging door having been previously sufficiently closed to allow the cabin to descend,
- said means all being of a passive and entirely mechanical type.

BRIEF DESCRIPTION OF THE DRAWINGS

Following is a description, by way of non limitative examples, of various operating modes of this invention, with reference to the appended drawings, in which.

DETAILED DESCRIPTION OF THE INVENTION

Figure 1:
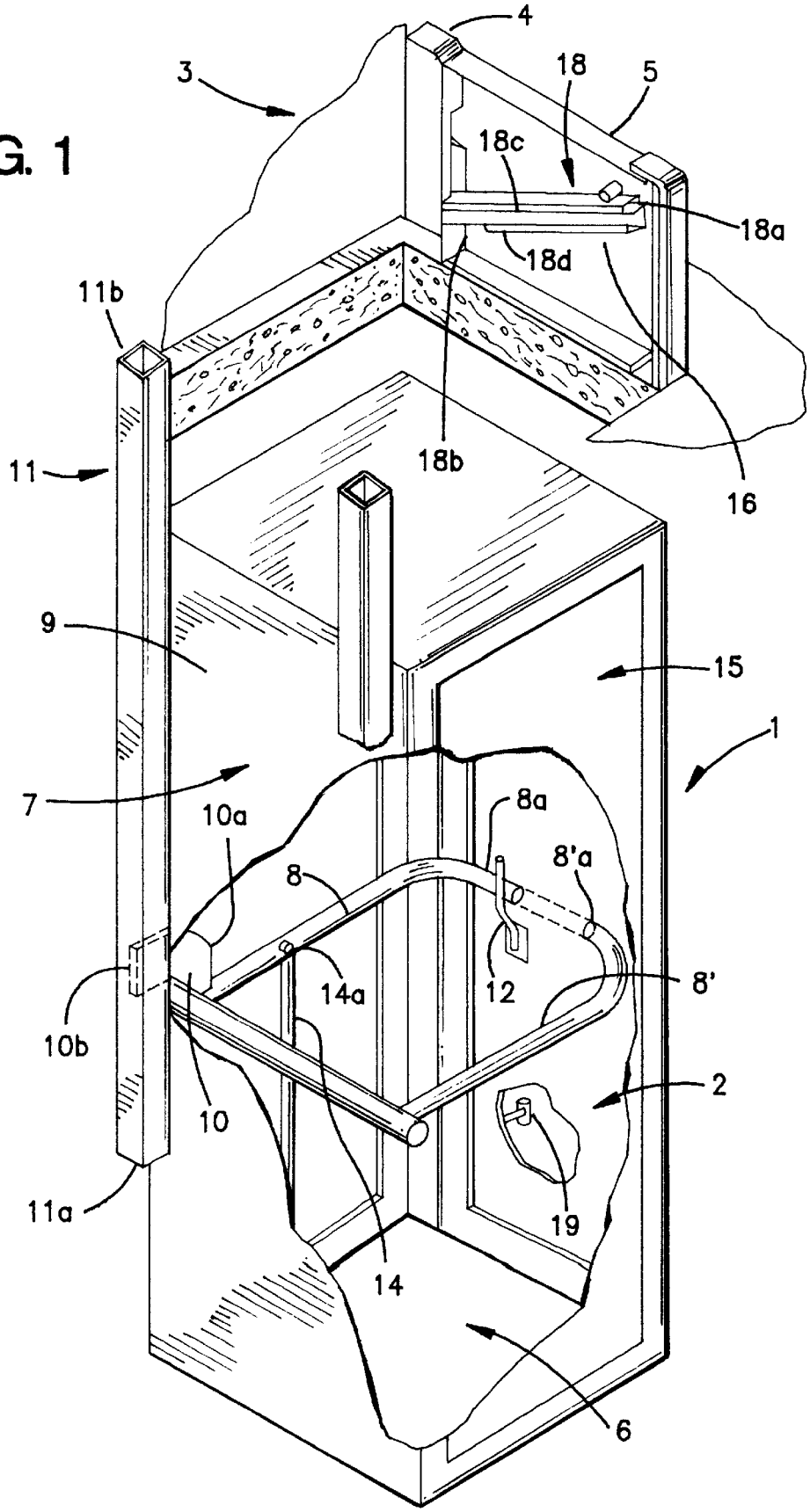
FIG. 1 is a perspective view of the elevator according to a first variant of the invention, the cabin being on its way up.
Figure 4:
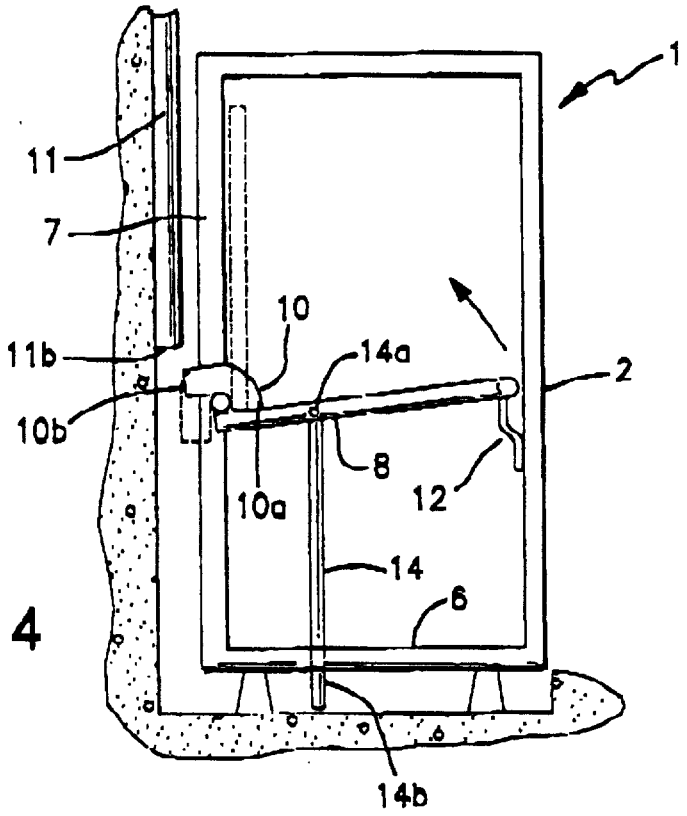
FIG. 4 is a view in elevation of the elevator in FIG. 1, the cabin being on the lower level.

The elevator according to the invention is only intended for use between two levels, as shown in perspective in FIG. 1, on which we voluntarily omitted to represent, for simplicity reasons, the means for elevating cabin 1 of the elevator, which means are not the object of this invention. Cabin 1 is closed by a swinging door 2 opening to the exterior, said cabin 1 traveling vertically from a lower level up to a booth 3, situated at an upper level and consisting of a railing 4 closed by a swinging landing door 5. In the very simple variant, shown in the figures, the cabin 1 comprises three vertical sidings, placed in a "U" formation closed by door 2 and mounted on a floorboard 6. Cabin 1 moves along guiding rails not shown in the figures, attached for example to a bearing wall of the residence and parallel to the exterior face of siding 7 of said cabin 1, opposite from door 2. According to this same variant, the elevator does not have a booth at the lower level, the passenger having direct access to cabin 1 when it is resting on the lower level, as is shown in FIG. 4. Landing door 5, which opens toward the exterior of cabin 1 is placed so that it is across from door 2 when cabin 1 is on the upper level, the articulations of said doors 2 and 5 being situated on the same side, as is shown in FIG. 1.

In order to ensure the safety of the passenger, the elevator has means, all of a passive and entirely mechanical nature, that condition the translational vertical movement of cabin 1, the locking and unlocking of doors 2 and 5, in accordance with the invention.

To begin with, the elevator has a locking arm 8 rotatably mounted about an axis that is interdependent with cabin 1. The axis can, for example, as is the case in FIGS. 1, 2A and 4, be horizontal and situated in siding 7. This locking arm 8 then oscillates along the lateral siding 9 of cabin 1 situated diagonally across from the articulation of door 2 of cabin 1. It is prolonged beyond said siding 7 by a cam 10 indented to work with a vertical fixed abutment 11 situated along the path of cabin 1. When the cabin is somewhere between the lower and upper level, as shown in FIG. 1, locking arm 8, in a horizontal position, acts as a holding rail and especially, ensures the locking of door 2 of cabin 1 by hooking its free end 8*a* in a tappet 12 placed on the internal face of door 2. This locking is made unalterable between the lower and the upper levels by its position with relation to back face 10*b* of cam 10 and abutment 11, which is positioned with relation to cabin 1 in a manner that maintains enough relative slack to allow the translational movement of cam 10 along said abutment 11 while keeping locking arm 8 from tipping. The length of abutment 11 is chosen so that unlocking of locking arm 8, and consequently of door 2 of cabin 1, is only possible when cabin 1 is in the right place on the upper or lower level. Obviously, any other kind of interaction between a cam interdependent with locking arm 8 and an abutment placed along the elevator is accessible to those skilled in the art and remains within the scope of the invention.

Figure 2A:
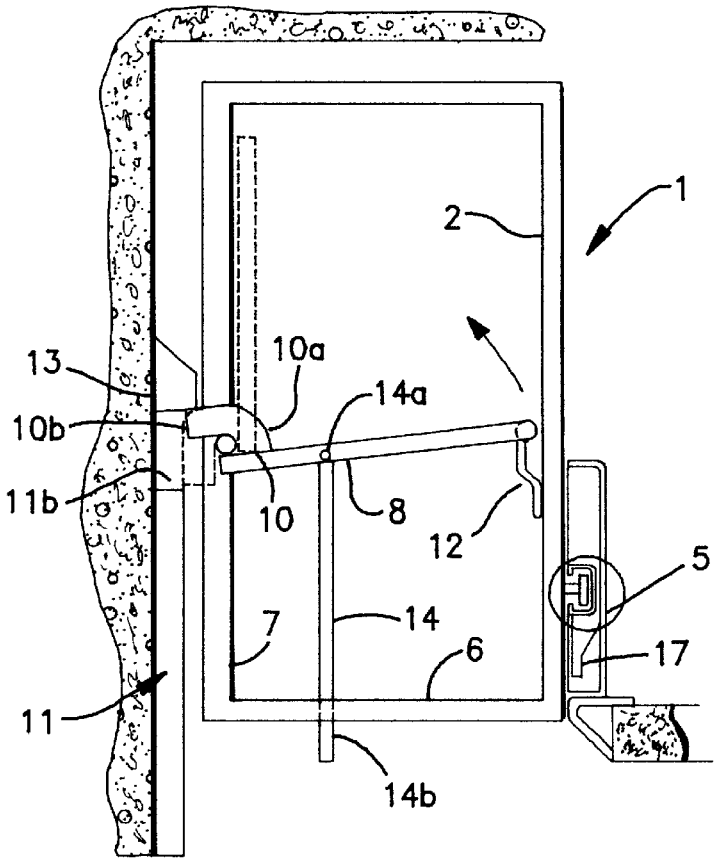
FIG. 2A is a vertical cross-section view of the elevator according to the second variant of the invention, the cabin being on the upper level.

When said cabin 1 arrives at the upper level, locking arm 8 is automatically unlocked by an abutment, for example, an elastic wedge 13 as shown in FIG. 2A and situated in the vertical prolongation of the superior end 11*b* of the vertical fixed abutment 11. Said wedge 13 causes, by hooking into cam 10, when the cabin 1 arrives at the upper level, a lifting of locking arm 8 at an angle sufficient to cause its free end 8*a* to come out of tappet 12. Therefore, to get out of said cabin 1, all its occupant has to do is to bring locking arm 8 back to a vertical position, then open door 2. A vertical descending movement will then only be possible again when door 2 is closed, which would otherwise block the downward movement because its panel would hit up against the floor of the upper level. If the door is closed, the downward movement will cause, by interaction between the back face 10*b* of cam 10 and the superior end 11*b* of abutment 11, said locking arm 8 to tip into a horizontal position about its rotation axis, which would then cause the locking of door 2 by hooking free end 8*a* of locking arm 8 in to tappet 12.

When, on the contrary, cabin 1 arrives at the lower level, locking arm 8 is then automatically unlocked by a lower level abutment consisting, for example, of an elastic rod 14 interdependent, at its upper end 14*a,* with locking arm 8, its lower end 14*b* passing through floorboard 6 of the cabin, as is shown in FIG. 4. The length of said lower end 14*b* is set so that when cabin 1 arrives at the lower level, it causes locking arm 8 to lift at an angle sufficient to cause its free end 8*a* to come out of tappet 12. Therefore, to get out of said cabin 1, all its occupant has to do is to bring locking arm 8 back to a vertical position, then open door 2. Going back up to the upper level will only be possible again if door 2 is closed and locking arm 8 is lowered. For as long as locking arm 8 is up, and out of tappet 12, cam 10 blocks the vertical ascending movement of cabin 1 by hooking its front face 10*a* onto the lower end 11*a* of abutment 11. The various different blocking motions performed by interactions between cam 10 and abutment 11 are made possible by the particular geometry of said cam 10. In the variant represented in the figures, this is done by having the height of cam 10, above the rotation axis of locking arm 8, greater than its length behind said axis. In practice, abutment 11 does not follow cam 10 all the way to its lowest position, which corresponds to cabin 1 at rest on the lower level. In fact, elastic rod 14 causes a slight lifting of locking arm 8 before this position, since it passes below floorboard 6 of cabin 1; it is therefore necessary that cam 10 be freed from its place along abutment 11 before cabin 1 has reached its resting position on the lower level. Abutment 11 is therefore shorter by about 10 centimeters. It is therefore possible to begin the upward movement with the locking arm 8 up and unlocked. However, the movement will be stopped after a rise of about ten centimeters, front face 10*a* of cam 10 hitting against lower end 11*a* of abutment 11. Furthermore, it is theoretically possible to begin an upward movement without having closed door 2; to do this it suffices to lower locking arm 8. In practice, this inconvenience is remedied by fixing an abutment to the ceiling, for example in the form of an arch, not shown in the figures, which descends down to just above the top of the panel of door 2.

According to a particular variant shown in FIG. 1, locking arm 8 is interdependent with a second arm 8' rotatably mounted about the same axis, along lateral siding 15 of cabin 1 situated on the same side as the articulation of door 2, said second arm 8' thereby constituting a second lowering holding rail. Locking arm 8 and second arm 8' can also join at their free ends 8*a* and 8'*a* to form a lowering holding bar.

The elevator of the invention also has a slideway, mounted pivoting in the plane of landing door 5 on the cabin 1 side. This slideway forms a bolt 16 which locks landing door 5 into a tappet 17 interdependent with guard rail 4 and situated opposite the articulation of landing door 5.

According to a first variant, not shown in the figures, bolt 16 is comprised of an "L"-shaped metal section, comprising a main wing 8, rotatably mounted by one of its ends 18*a*, in the plane of landing door 5, about an axis perpendicular to said door 5, and interacting, at its other end 18*b,* with tappet 17 of landing door 5. Main wing 18 is bordered lengthwise by a lateral upper wing 18*c* first running perpendicularly to said main wing 18 in the direction of cabin 1, then in parallel along main wing 18, in order to form a channel.

Figure 3B:
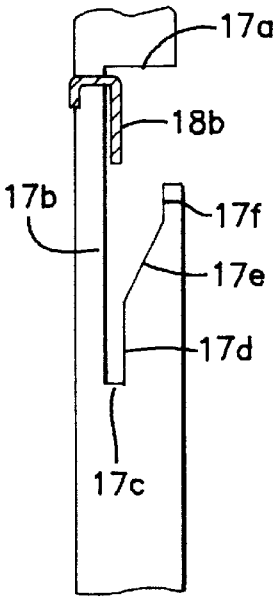
FIG. 3*b* is a section view taken along line IIIb—IIIb in FIG. 3*a,*
Figure 3C:
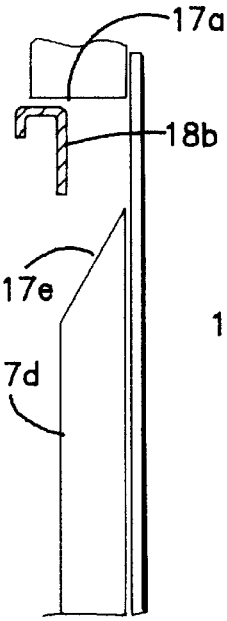
FIG. 3*c* is a section view taken along line IIIc—IIIc in FIG. 3*a,*
Figure 3A:
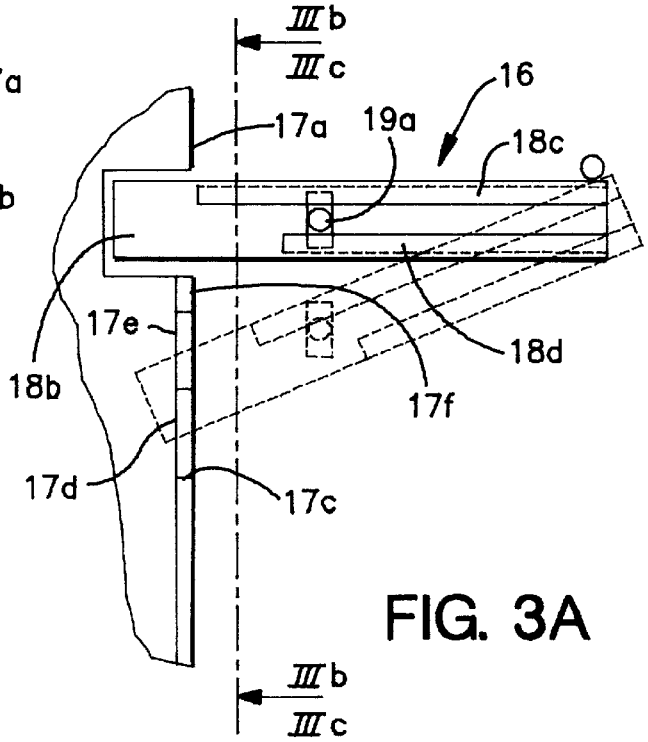
FIG. 3*a* is a view in elevation of the upper level landing door seen from the side of the mechanism.

According to a second preferential variant shown in FIG. 3*a,* bolt 16 consists of a "C"-shaped metal section, consisting of the same main wing 18 which is further bordered by a lower lateral wing 18*d.* The upper lateral wing 18*c* and lower lateral wing 18*d* first run perpendicular to said main wing 18 in the direction of cabin 1, then towards each other parallel to main wing 18, in order to form a channel, with upper lateral wing 18*c* stemming out beyond lower lateral wing 18*d,* on the side of extremity 18*b* interacting with tappet 17.

Tappet 17 consists of a cut into the width of said guard rail 4, emerging across from cabin 1 and limited by a first horizontal edge 17*a,* prolonged toward the bottom and on cabin 1 side, by a second vertical edge 17*b,* itself prolonged toward the outside of cabin 1 by a third horizontal edge 17*c,* itself prolonged toward the top by a fourth vertical edge 17*d,* itself prolonged toward the top and the outside of cabin 1 by a fifth edge 17*e* forming an oblique ramp and prolonged by a sixth vertical edge 17*f,* ending vertical to the origin of the first edge 17*a,* and at a distance from this first upper edge 17*a* greater than the width of main wing 18 of bolt 16. The second vertical edge 17*b,* the third horizontal edge 17*c* and the fourth vertical edge 17*d* form a vertical slit intended to receive end 18*b* of bolt 16 which, when it is fully entered, is inclined below its articulation axis perpendicular to landing door 5. This first variant is shown in FIGS. 3*a* and 3*b*. A minimal variant which operates well is shown in FIG. 3*c*. Tappet 17 only has the fourth vertical edge 17*d* and the fifth edge 17*e* forming the oblique ramp. Rotation stop of landing door 5 is no longer effectuated by bolt 16, but by a cover plate, placed along the vertical outside edge of the panel of landing door 5 that pushes against guard rail 4. Similarly, rotation stop of bolt 16 is performed by an abutment provided on landing door 5.

Figure 2B:
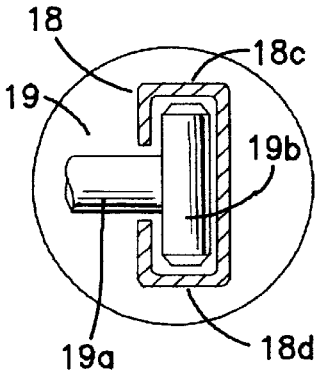
FIG. 2B is an enlarged fragment of FIG. 2A.

Said bolt 16 interacts with a stud protruding from the exterior surface of door 2 of cabin 1, which, when cabin 1 reaches the upper level, slips into the channel to lift bolt 16 out of tappet 17 and thereby unlock the upper landing door 5. In the event that main wing 18 of bolt 16 does not have a lower wing 18*d,* this stud can be a stem, not shown in the figures, in form of an "L" whose leg is positioned horizontally and attached, at its free end, perpendicularly to the external surface of door 2, so that the foot of the "L" is vertical and pointing upwards. Within the framework of the preferential variant shown in FIGS. 2 and 3, in which main wing 18 of bolt 16 has a lower wing 18*d,* the stud is a stem 19 in "T" form, the foot 19*a* of which, placed horizontally, is fixed, at its free end, perpendicularly to the outer surface of door 2 so that the horizontal bar 19*b* of the "T" is vertical. When cabin 1 arrives at the upper level, the upper end of bar 19*b* of the "T" is inserted between main wing 18 and upper lateral wing 18*c,* on the end 18*b* side of bolt 16, thanks to the shorter length of lower wing 18*d.* Stud 19 is placed on door 2 of cabin 1 in such a way that when said cabin 1 reaches its maximum height in booth 3, said stud 19, in its vertical movement, has dragged bolt 16 high enough so that its end 18*b* is situated above the level of the sixth horizontal edge 17*f* of tappet 17. Landing door 5 is thus unlocked. Furthermore, the length of lower wing 18*d* is such that, when bolt 16 has finished the rotational movement which brought it to the unlocked position, the end of said inferior wing 18*d* is below the lower end of bar 19*b* of the "T", as indicated by the solid lines on FIG. 3*a.* Stud 19 is thereby hooked by both ends of bar 19*b* of its "T" in the channel formed by upper lateral wing 18*c* and lower lateral wing 18*d* of bolt 16. Landing door 5 and door 2 of cabin 1 are then interdependent in rotation about their respective axes; the opening or the closing of one causes the opening or the closing of the other, and vice versa. The interval existing between the articulations of doors 2 and 5 is compensated, during the maneuver of said doors 2 and 5 by the sliding of bar 19*b* of the "T" into the channel formed by upper lateral wing 18*c* and lower lateral wing 18*d*. Of course the same result is obtained with the "L"-shaped stud, which allows for a simpler design, but presents the risk of having wing 18 of bolt 16, for example because of vibrations, joggle out and come unhooked from the foot of the "L", thereby causing an accidental disengagement of doors 2 and 3.

In order to descend from the upper level to the lower level, cabin 1 being in the right place at the upper level, and landing door 5 as a consequence being unlocked, the passenger, after having opened said landing door 5, thereby causing door 2 of cabin 1 to open, penetrates inside said cabin 1 which he closes by pulling door 2, and consequently landing door 5. If said door 2 is not sufficiently closed, the downward movement of cabin 1 will be blocked by the lower end of the panel of said door 2 hitting against the floor of the upper level. However, if said door 2 is sufficiently closed to allow the descent of cabin 1 but not enough to allow extremity 8*a* of locking arm 8 to hook into tappet 12 located on the internal face of door 2, we apparently are confronted by a situation which is doubly dangerous since, on the one hand, cabin 1 will be allowed to execute its downward movement without door 2 being locked, and furthermore landing door 5 could possibly remain unlocked, whereas cabin 1 would no longer be in the right position on the upper level. To remedy this inconvenience, the inclination and the length of the oblique ramp formed by fifth edge 17*e* of tappet 17 as well as the length of stud 19 are set so that, as soon as the position of door 2 allows the downward movement of cabin 1, which is to say as soon its panel is no longer above the level of the floor of the upper landing, extremity 18*b* of bolt 16 is situated at least vertical to the upper part of said ramp. In such a manner, when cabin 1 is going down, bolt 16, which is going to go down at first dragged by stud 19, then, when bar 19*b* of the "T" is no longer on lower lateral wing 18*d* which will have rotated away, pulled by its weight alone, will slide along said ramp and place itself, by its end 18*b* in the vertical slit of tappet 17, thereby ensuring the locking and proper closing of landing door 5, by rotation of this later around its articulation. Furthermore, this rotational movement is communicated by landing door 5 to door 2 via stud 19, thereby allowing for the complete closing of said door 2, and this, before locking arm 8 has completed its downward movement, pulled by the interaction between back face 10*b* of cam 10 and upper end 11*a* of abutment 11, thereby ensuring the locking of door 2 by hooking free end 8*a* into tappet 12. The chronological occurring order of the different phases may, for example, be obtained by the adapted profile of cam 10. Similarly, as was already stated above, the length of lower wing 18*d* is selected so that, when bolt 16 is at the bottom of the vertical slit of tappet 17, stud 19 is free to pursue its translational movement downward. Finally, the use of the oblique ramp of tappet 17 also makes it possible, with the same mechanism, to ensure the complete closing and locking of landing door 5 when the complete closing of door 2 does not suffice, for example, because of the functional slack existing between stud 19 and bolt 16. Similar results can be obtained with a "L"- shaped stud and bolt 16 without lower lateral wing 18*d*, the descending of said bolt 16 being induced, in this case, by its weight alone. However, the risk of its coming unhooked and thereby causing the accidental disengagement of doors 2 and 5 is greater.

Figure 5:
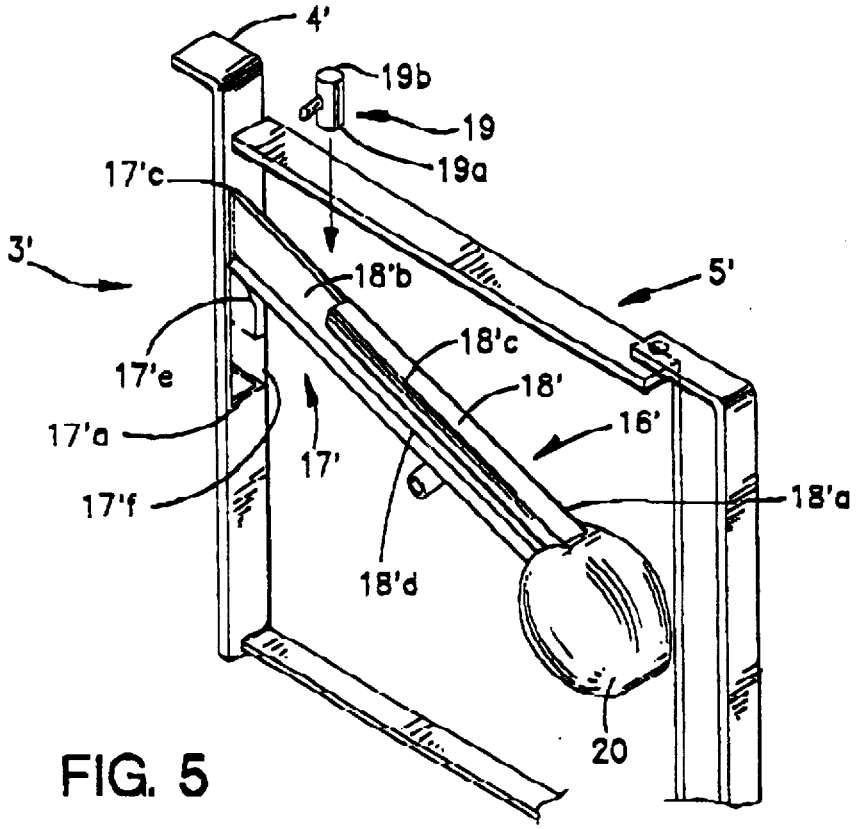
FIG. 5 is a perspective view of the bolt of the lower level landing door according to a third variant of the invention.

According to a particular variant shown in FIGS. 2A and 5, the elevator of the invention has a booth 3' at the lower level, closed by a swinging landing door 5', normally locked, opening to the exterior of cabin 1 by an articulation situated on the same side as that of door 2 of cabin 1. It is then provided with means, similar to those of upper landing door 5, which allow to:

- automatically join in rotation around their respective articulations door 2 of cabin 1 and lower landing door 5' when cabin 1 reaches the lower level,
- automatically disconnect the door 2 of cabin 1 and lower landing door 5' when cabin 1 leaves the lower level,
- automatically unlock, upon downward movement of cabin 1, lower landing door 5' when the cabin 1 reaches the lower level,
- upon upward movement of cabin 1 leaving the lower level , automatically completely close the landing door 5' and door 2 of cabin 1, and simultaneously lock said doors 2 and 5', the swinging panel of said door 2 having been previously sufficiently closed to allow cabin 1 to go up.

Of course all said means are again passive and entirely mechanical and consist in an interaction between stud 19 and a channel, mounted pivoting in the plane of lower landing door 5' on the cabin 1 side to form a bolt 16' which locks landing door 5' in a tappet 17' interdependent with safety railing 4' and situated opposite the articulation of said landing door 5'.

Lower bolt 16' and tappet 17' are symmetrical to bolt 16 and tappet 17 relative to a horizontal plane situated half-way between the upper and lower levels. Bolt 16' is comprised, for example, of a "L"-shaped metal section, comprising a main wing 18', rotatably mounted by one of its ends 18'*a,* in the plane of landing door 5' about an axis perpendicular to said door 5' and interacting, at its other end 18'*b,* with tappet 17' of landing door 5'. Main wing 18' is bordered lengthwise by a lateral lower wing 18*d*, which first runs perpendicularly to said main wing 18' in the direction of cabin 1, then in parallel along the length of main wing 18', in order to form a channel. According to another preferential variant shown in FIG. 5, bolt 16' consists of a "C"-shaped metal section, consisting of the preceding main wing 18' which is further bordered along its length by a second upper lateral wing

18'*c*. Upper lateral wing 18'*c* and lower lateral wing 18*d* both first run perpendicularly to said main wing 18' in the direction of cabin 1, then toward each other, parallel to main wing 18', in order to form a channel, lower lateral wing 18*d* sticking out further, on the side of the end interacting with tappet 17', than upper lateral wing 18*c*.

Similarly, said tappet 17' consists of a cut into the width of guard rail 4', emerging across from cabin 1 and limited by a first horizontal edge 17'*a,* prolonged toward the top and on cabin 1 side by a second vertical edge 17'*b,* itself prolonged toward the outside of cabin 1 by a third horizontal edge 17'*c,* itself prolonged toward the bottom by a fourth vertical edge 17'*d,* itself prolonged toward the bottom and the outside of cabin 1 by a fifth edge 17'*e* forming an oblique ramp and prolonged by a sixth vertical edge 17'*f,* ending vertical to the origin of the first edge 17*a,* and at a distance from this first upper edge 17*a* greater than the width of main wing 18' of bolt 16'. The second vertical edge 17'*b,* the third horizontal edge 17'*c* and the fourth vertical edge 17'*d* form a vertical slit intended to receive end 18'*b* of bolt 16' which, when it is fully entered, is inclined above its articulation axis perpendicular to landing door 5'. For this, bolt 16' is prolonged beyond its rotation axis, by a counterweight 20 which ensures its inclination above its articulation axis and consequently, the locking of lower landing door 5' when stud 19 is not in the channel of said door 5'. Such device is shown in FIG. 5. Any other equivalent means, ensuring the locking of bolt 16', such as a spring, would obviously still be within the scope of the invention. According to a minimal variant, not shown in the figures, which operates well, tappet 17' only has the fourth vertical edge 17'*d* and the fifth edge 17'*e* forming the oblique ramp. The rotation stop of landing door 5' is no longer effectuated by bolt 16', but by a cover plate, placed along the vertical outside edge of the panel of landing door 5' and that pushes against guard rail 4'. Similarly, the rotation stop of bolt 16' is performed by an abutment provided on landing door 5'.

The functioning described above, for landing door 5 of the upper level, is of course valid for landing door 5' of the lower level, under the condition that the direction of the movement is inverted. This variant, in which there is a booth 3' at the lower level, has the advantage of making any upward movement of cabin 1 strictly impossible when door 2 is open, as the top of its swinging panel would hit up against the top of guard rail 4'. It is therefore not necessary to have an arch above the opening of the panels of door 2.

Figure 2C:
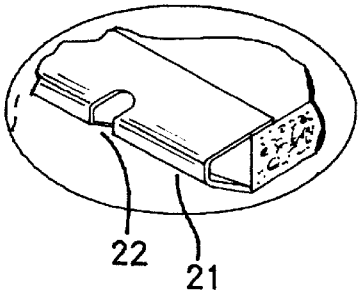
FIG. 2C is a variant of the structure shown in FIG. 2B.

This variant requires, however, an extra arrangement in the form of a step 21, represented in FIG. 2C, attached to the upper level and having a cut 22 which allows the passage of stud 19 provided on door 2 of cabin 1. Indeed, in the case where only the upper level has a booth 3, it is possible to set the door 2 away from floorboard 6 of cabin 1, and with it, stud 19. For this, it suffices that bolt 16 goes beyond the limit of the ground of the upper level, above the part of floorboard 6 that goes beyond door 2, to be able to interact with stud 19. This arrangement, which has the advantage of having floorboard 6 be flush with the ground of the upper level, is not possible when a lower landing door 5' is used, as floorboard 6 of cabin 1 would come in contact with lower bolt 16' when cabin 1 is on its way down. This is why floorboard 6 of cabin 1 stops right at the beginning of door 2 of said cabin 1. The space between said floorboard 6 of cabin 1, in the right position at the upper level, and the floor of the upper level is filled by step 21.

Finally, in the case where, for reasons of the lay out of the area where the elevator is to be installed, access to cabin 1 is not possible from the same side of said cabin 1 on the upper level and the lower level, it is quite possible, according to a variant not shown in the figures, to replace one of the lateral sidings 9, 15 by a second door to cabin 1. This second door would also have a tappet on the inner side of its panel, in which would enter, not end 8*a* or 8'*a* of locking arm 8 or 8', but locking arm 8 or 8' itself. Each of the two doors of the cabin could be provided with a stud and cooperate with its respective landing door, said landing doors 5 and 5' no longer being situated one above the other.

I claim:

1. An elevator which operates between a lower level and an upper level, comprising a cabin (1) closed by a swinging door (2) which opens to the exterior, said cabin (1) moving by translational vertical motion from a lower level up to a booth (3), situated at an upper level and comprising a guard rail (4) closed by a swinging landing door (5) which is normally locked, opening toward the exterior of the cabin (1) by means of an articulation situated on the same side as door (2) of said cabin (1) , characterized in that it is provided with means allowing to:

automatically unlock the door (2) of the cabin (1) when said cabin (1) arrives at the right place on the upper or lower level, block the cabin (1) at the upper level until the door (2) to said cabin (1) has been properly closed, block the cabin (1) at the lower level until the door (2) to said cabin (1) has been manually closed and locked, lock the door (2) of the cabin (1) between the upper and lower levels, automatically join in rotation around their respective articulations the door (2) to the cabin (1) and the landing door (5) when said cabin (1) reaches the upper level, automatically disconnect the door (2) to the cabin (1) and the landing door (5) when said cabin (1) leaves the upper level, automatically unlock, upon upward movement of the cabin (1), the landing door (5) when said cabin (1) reaches the upper level, upon downward movement of the cabin (1) leaving the upper level, automatically completely close the landing door (5) and the door (2) of said cabin (1), and simultaneously lock said doors (2, 5), the swinging door (2) having been previously sufficiently closed to allow the cabin (1) to descend, said means all being passive and entirely mechanical.

2. Elevator according to claim 1 characterized in that the passive and entirely mechanical type of means consist of:

a locking arm (8), rotatably mounted about an axis interdependent with the cabin (1) and ensuring alternatively by pivoting in a tappet (12) placed on the internal side of the door (2) of the cabin (1), the locking of said door (2) and simultaneously the unblocking of the translational motion of said cabin (1), or the unlocking of said door (2) and simultaneously the blocking of the translational motion of said cabin (1), a channel, mounted pivoting in the plane of the landing door (5) on the cabin (1) side, to form a bolt (16) which locks the landing door (5) in a tappet (17) joined to guard rail (4) on the side situated opposite the articulation of the landing door (5), a stud (19) protruding from the exterior surface of the door (2) of the cabin (1), which, when cabin (1) reaches the upper level, slips into the channel to lift the bolt (16) out of the tappet (17) and thereby unlock the landing door (5).

lower level stoppers (14) and upper level stoppers (13) which respectively provide for the automatic unlocking of the door (2) when the cabin (1) arrives at the right place at the upper and lower levels.

3. Elevator according to claim 2 characterized in that the locking arm (8) has a cam (10) which controls the pivotal movement of said locking arm (8) between:

a position out of the tappet (12) wherein:

* when the cabin (1) is at the lower level, the cam (10) blocks the vertical upward movement of the cabin (1) by hooking the lower extremity (11*a*) of a vertical fixed abutment (11) placed along the path of said cabin (1)

* when the cabin (1) is at the upper level, the cam (10) causes, by interaction with the upper end (11*b*) of said vertical fixed abutment (11), upon downward movement of the cabin (1) , the locking arm (8) to tip into a horizontal position about its rotation axis, and a horizontal position in which said locking arm (8) ensures the locking of the door (2) of cabin (1) by hooking its free extremity (8*a*) in the tappet (12), the locking of which is made unalterable between the lower and the upper levels because of cam (10) along the length of the fixed vertical abutment (11).

4. Elevator according to claim 2 characterized in that the bolt (16) is comprised of a "L"-shaped metal section, comprising a main wing (18), rotatably mounted at one of its ends (18*a*), in the plane of the landing door (5) about an axis perpendicular to said door (5) and interacting, at its other extremity (18*b*), with the tappet (17) of the landing door (5), said main wing (18) being bordered lengthwise by a lateral upper wing (18*c*), which first runs perpendicularly to said main wing (18) in the direction of the cabin (1), then in parallel along the length of the main wing (18), in order to form a channel.

5. Elevator according to claim 2 characterized in that the bolt (16) consists of a "C"-shaped metal section, consisting of a main wing (18) which is bordered along its length by a second lower lateral wing (18*d*), the upper lateral wing (18*c*) and lower lateral wing (18*d*) both first run perpendicularly to said main wing (18) in the direction of the cabin (1), then toward each other, parallel to the main wing (18), in order to form a channel, the upper lateral wing (18*c*) extending, on the side of the end interacting with the tappet (17), beyond lower lateral wing (18*d*).

6. Elevator according to claim 2 characterized in that the tappet (17) consists of a cut into the width of the guard rail (4), said cut emerging horizontally from either side of the width of the guard rail (4) and being limited at the bottom by a first vertical edge (17*d*), prolonged toward the top and toward the outside of the cabin (1) by a second edge (17*e*), forming an oblique ramp whose upper end is away from the top of the cut by a distance greater than the width of the main wing (18) of the bolt (16).

7. Elevator according to claim 2 characterized in that:

the upper abutment consists of an elastic wedge (13) situated in the vertical prolongation of the upper end (11*b*) of the vertical fixed abutment (11) and ensures, by hooking the cam (10), when the cabin (1) arrives at the upper level, a lifting of the locking arm (8) at an angle sufficient to cause its free end (8*a*) to come out of the tappet (12).

the lower abutment consists of an elastic rod (14) interdependent, at its upper end (14*a*), with the locking arm (8) and passing through floorboard (6) of the cabin at its lower end (14*b*), with a length which is such that, when the cabin (1) arrives at the lower level, it lifts locking arm (8) at an angle sufficient to cause its free end (8*a*) to come out of the tappet (12).

8. Elevator according to claim 2 characterized in that the locking arm (8) is interdependent with a second arm (8') rotatably mounted about the same axis, said arms (8, 8') being able to be joined by their respective free ends (8*a*, 8'*a*) to form a lowering support arch.

9. Elevator according to claim 2 characterized in that the stud is a stem in the form of an "L" whose leg is positioned horizontally attached, at its free end, perpendicularly to the external surface of the door (2) so that the foot of the "L" is vertical and pointing upwards.

10. Elevator according to claim 2 characterized in that the stud is a stem (19) in the form of a "T" the foot (19*a*) of which, situated horizontally, is fixed, at its free end, perpendicularly to the outer surface of the door (2) so that the bar (19*b*) of the "T" is vertical.

11. Elevator according to claim 10, which has at the lower level, a booth (3') closed by a landing door (5') with a swinging panel, normally locked, opening to the exterior of the cabin (1) by an articulation situated on the same side as that of door (2) of the cabin (1) characterized in that it is provided with means to:

automatically join in rotation around their respective articulations the door (2) of the cabin (1) and the landing door (5') when the cabin (1) reaches the lower level, automatically disconnect the door (2) of the cabin (1) and the landing door (5') when the cabin (1) leaves the lower level, automatically unlock, upon downward movement of the cabin (1), the landing door (5') when said cabin (1) reaches the lower level, upon upward movement of the cabin (1) leaving the lower level, automatically completely close the landing door (5 1) and the door (2) of said cabin (1), and simultaneously, lock said doors (2, 5'), the panel of said door (2) having been previously sufficiently closed to allow the cabin (1) to go up, said means all being passive and entirely mechanical.

12. Elevator according to claim 11 characterized in that the passive and entirely mechanical type means comprise:

a slideway, mounted pivoting in the plane of the lower landing door (5') on the cabin (1) side to form a bolt (16') which locks said landing door (5') in a tappet (17') joined to the safety railing (4') and situated opposite the articulation of said landing door (5') and, the stud (19) protruding from the outer surface of the door (2) of the cabin (1).

13. Elevator according to claim 12 characterized in that the bolt (16') consists of a "L"-shaped metal section, comprising a main wing (18'), rotatably mounted at one of its ends (18'*a*), in the plane of the landing door (5') about an axis perpendicular to said door (5') and cooperating, at its other end (18'*b*), with the tappet (17') of the landing door (5'), said main wing (18') being bordered lengthwise by a lateral lower wing (18'*d*) which first runs perpendicularly to said main wing (18') in the direction of the cabin (1), then in parallel along the length of main wing (18'), in order to form a channel.

14. Elevator according to claim 12 characterized in that the bolt (16') consists of a "C"-shaped metal section, consisting of a main wing (18') which is bordered along its length by a second upper lateral wing (18'*c*), the upper lateral wing (18'*c*) and lower lateral wing (18'*d*) both first run perpendicularly to said main wing (18') in the direction of the cabin (1), then toward each other, parallel to the main wing (18'), in order to form a channel, lower lateral wing (18'*d*) extending, on the side of the end interacting with the tappet (17'), beyond the upper lateral wing (18*c*).

15. Elevator according claim 12 characterized in that the tappet (17') in that it consists of a cut into the width of the guard rail (4'), said cut emerging horizontally on either side of the width of said guard rail (4') and being limited at the top by a first vertical edge (17'*d*), itself prolonged toward the bottom and the outside of the cabin (1), by a second edge (17'*e*), forming an oblique ramp whose lower extremity is distanced from the bottom of the cut, by a distance greater than that of the width of the main wing (18') of the bolt (16').

16. Elevator according to claim 12 characterized in that the floorboard (6) of the cabin (1) stops flush with the door (2) of said cabin (1) and in that the space between said floorboard (6) of said cabin (1), in the right position at the upper level, and the floor of the upper level is filled by a step (21), interdependent with the upper level, having a cut (22) that allows for the passage of the stud (19) provided on the door (2) of the cabin (1).

* * * * *